US006092694A

United States Patent [19]

Sadow

[11] Patent Number: 6,092,694

[45] Date of Patent: Jul. 25, 2000

[54] HOLY WATER DISPENSER HAVING A RELIGIOUS DOOR ORNAMENT

[75] Inventor: Bernard Sadow, Chappaqua, N.Y.

[73] Assignee: Outrigger, Inc., Chappaqua, N.Y.

[21] Appl. No.: 09/247,127

[22] Filed: Feb. 9, 1999

[51] Int. Cl.[7] ..... B67D 5/06

[52] U.S. Cl. ..... 222/78; 222/179.5; 222/180; 222/183; 222/321.7

[58] Field of Search ..... 222/78, 156, 179.5, 222/180, 183, 321.7, 321.9

[56] References Cited

U.S. PATENT DOCUMENTS

| | | | |
|---|---|---|---|
| 2,098,344 | 11/1937 | Le Boeuf | 222/78 |
| 2,948,439 | 8/1960 | Glover et al. | 222/183 |
| 3,101,160 | 8/1963 | Picot | 222/183 |
| 3,224,644 | 12/1965 | Davis | 222/180 |
| 4,433,796 | 2/1984 | Brooks, Jr. | 222/183 |
| 4,749,104 | 6/1988 | Chao | 222/78 |
| 5,598,954 | 2/1997 | Salzano | 222/162 |

FOREIGN PATENT DOCUMENTS

| | | | |
|---|---|---|---|
| 727983 | 4/1955 | United Kingdom | 222/180 |

*Primary Examiner*—Joseph A. Kaufman
*Attorney, Agent, or Firm*—Ezra Sutton

[57] ABSTRACT

A dispenser for holding and dispensing holy water on the user includes a religious ornament on the front of the dispenser for displaying a religious entity, and a mounting plate for mounting the dispenser on a wall or a door of a home or a building. The alternate embodiment includes a dispenser for holding and dispensing holy water on the user, a holding receptacle having a front wall for holding the dispenser in place, a religious ornament mounted on the front wall of the holding receptacle for displaying a religious entity, and a pair of inverted U-shaped channel members for mounting the holding receptacle on a wall or a door of a home or a building.

31 Claims, 3 Drawing Sheets

HOLY WATER DISPENSER HAVING A RELIGIOUS DOOR ORNAMENT

FIELD OF THE INVENTION

This invention relates to a holy water dispenser having a religious ornament and is mountable on a door or wall for dispensing holy water on the user.

BACKGROUND OF THE INVENTION

In the Roman Catholic Church, as well as the Greek Orthodox Catholic Church, the use of holy water for religious observance, reverence, veneration, and ceremony is well known to Catholic Church attendees. Typically, the holy water is used in conjunction with prayers and blessings during the church services and constitutes an important part of the individual's personal religious ritual and experience when attending these services. Generally, at each of the entrance ways to Catholic Churches there are positioned one or more holy water fonts or basins. Traditionally, these basins of blessed water/holy water are used by the church practitioners, wherein each member places their fingers within the basin for the purpose of blessing themselves with the sign of the cross.

Rarely is the church member able to make use of the holy water for religious blessing, except where a font of holy water is provided as in a church, a religious sanctuary, a monastery, a nunnery, or in other types of religious environments. Usually, these church members find solace and comfort in carrying their cross, rosary, Bible, religious medal or holy statue. But many of these church members feel the need of the blessing associated with the use of holy water when outside of the church environment, whether they be at home or at work or other non-religious environments or places.

There remains a need for a religious ornament having a holy water dispenser therewith for holding and dispensing the holy water on the user. Additionally, this religious ornament having a holy water dispenser therewith should be mountable on a door or wall of a home or building. Further, this religious ornament should also be used in vehicles, such as cars, trucks, buses, trains and airplanes, and attached appropriately by double-sided tape or Velcro™ to an interior wall, interior door, sun visor or other areas of that vehicle when travelling.

DESCRIPTION OF THE PRIOR ART

Door associated liquid dispensers of various designs, configurations, structures and materials of construction have been disclosed in the prior art. For example, U.S. Pat. Nos. 4,421,254; 5,598,954; and 5,368,204 to Spector, Salzano and Smith, respectively, all disclose various forms of door or wall associated liquid dispensers that spray and dispense an aromatic disinfectant.

U.S. Pat. No. 5,489,045 to JENNINGS discloses an anti-burglar alarm attached to a door that sprays and dispenses tear gas on to an intruder.

U.S. Pat. No. 5,381,022 to MEDYNSKI, discloses a holy water dispenser which is a floor mounted apparatus that includes a photoelectric cell for dispensing the holy water when the user's hand is placed below the dispensing spout.

U.S. Pat. No. 3,294,288 to MACARE disclose a ceremonial holy water font that is portable and easily mountable such that the user can dispense a small stream of the holy water on the user's fingers when pressure is applied to the orifice of the font.

U.S. Pat. No. 1,983,742 to DICKS discloses a door mountable religious ornament but does not include a liquid dispenser.

None of the aforementioned patents disclose or teach the structure, configuration and design of a religious mountable ornament having a dispenser for dispensing holy water on the user.

Accordingly, it is an object of the present invention to provide a mountable religious ornament having a holy water dispenser therewith for holding and dispensing holy water on the user.

Another object of the present invention is to provide a mountable religious ornament that is made from a moldable and durable plastic or is made from a formable metal such as aluminum, stainless steel, steel, zinc, copper or other metals.

Another object of the present invention is to provide a mountable religious ornament that can be mounted on a door or wall of a home or building, as well as temporarily attached to an interior wall or door of a vehicle.

Another object of the present invention is to provide an alternate mountable religious ornament that includes a dispenser for holding and dispensing holy water, and a holding member having a religious symbol thereon such that the dispenser is retained within the holding member.

Another object of the present invention is to provide a mountable religious ornament having a holding member made from a moldable and durable plastic or is made from formable metal such as aluminum, steel, stainless steel, zinc, copper or other metals.

A further object of the present invention is to provide a mountable religious ornament that can be mass produced in an automated and economical manner and is readily affordable by the user.

SUMMARY OF THE INVENTION

The preferred embodiment of the present invention provides for a holy water dispenser molded from plastic or metal having a religious ornament thereon mountable on a wall or a door. The preferred embodiment includes a dispenser for holding and dispensing holy water on the user; a religious ornament on the front of the dispenser for displaying a religious entity; and a mounting plate member for mounting the dispenser on a wall or a door of a home or a building.

The alternate embodiment of the present invention provides for a holy water dispenser having a holding member with a religious ornament thereon mountable on a wall or door. The alternate embodiment includes a dispenser for holding and dispensing holy water on the user; a holding member having a front wall for holding the dispenser in place; a religious ornament mounted on the front wall of the holding member for displaying a religious entity; and a pair of inverted U-shaped channel members for mounting the holding member on a wall or a door of a home or a building. The holding member is in the form of a container for receiving the dispenser therein.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENTS

OVERVIEW

Figure 1:
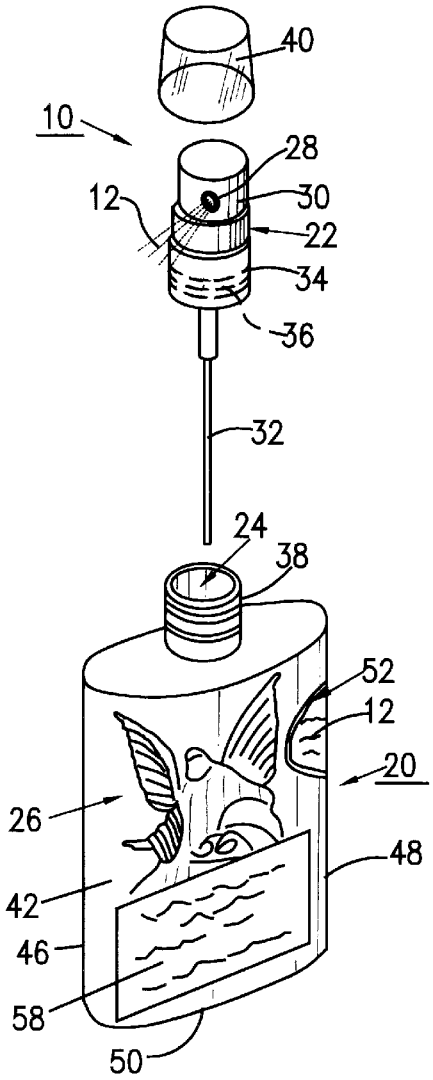
FIG. 1 is an exploded front perspective view of the religious mountable ornament of the preferred embodiment of the present invention showing the cover cap, the dispensing member, the dispenser container having a religious symbol with indicia thereon.

The religious mountable ornaments 10 and 100 having a dispenser 20 or 120 for holding and dispensing of holy water 12 of the preferred and alternate embodiments of the present invention are represented in detail by FIGS. 1 to 8 of the patent drawings. In the preferred embodiment, the religious ornament 10, as shown in FIGS. 1 through 4, is in the form of a molded plastic or light-weight metal dispenser 20 having a molded religious medal or symbol 56 thereon.

The religious mountable ornament 100 of the alternate embodiment, as shown in FIGS. 5 through 8, of the present invention includes a dispenser container 120 held within a holding member 160 having a religious medal 190 attached thereon. In all other respects, the religious mountable ornament 100 of the alternate embodiment functions and operates in the same manner as the religious mountable ornament 10 of the preferred embodiment.

PREFERRED EMBODIMENT 10

Figure 2:
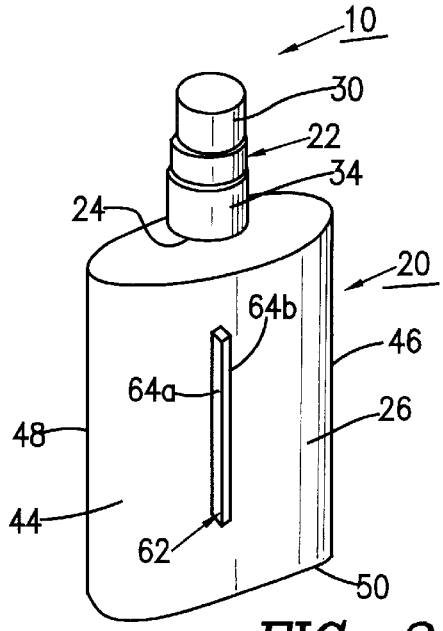
FIG. 2 is a rear perspective view of the religious mountable ornament of the preferred embodiment of the present invention showing the dispensing member and the dispenser container having an elongated and vertically aligned bar member thereon.
Figure 3:
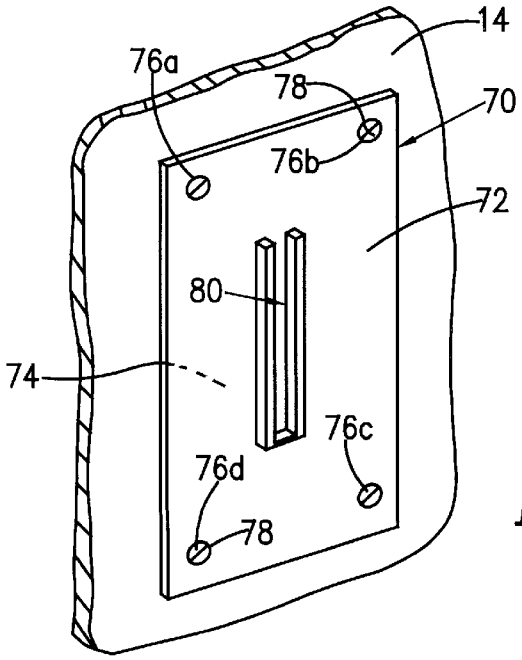
FIG. 3 is a front perspective view of the religious mountable ornament of the preferred embodiment of the present invention showing the holding plate member having a centrally located and vertically aligned U-shaped and tapered wall receiving channel member thereon.
Figure 4:
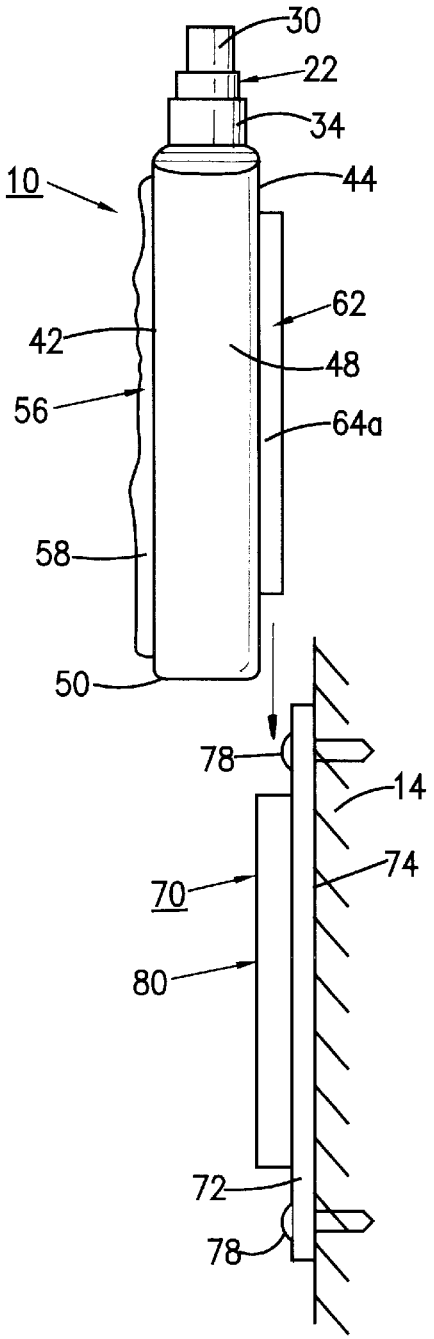
FIG. 4 is a side elevational view of the religious mountable ornament of the preferred embodiment of the present invention showing the tab member of the container housing being received within the receiving channel member of the mounting plate member attached to the wall of the user's home.

The religious mountable ornament 10 and its component parts of the preferred embodiment of the present invention are represented in detail by FIGS. 1 through 4. The molded religious ornament 10 is mountable on a wall 14 or a door of a home or a building, as shown in FIG. 4 of the drawings. In addition, the religious ornament 10 can be temporarily attached to an interior wall or door of a vehicle, such as a car, a truck, a van, a bus, a train, an airplane or a recreational vehicle using double-sided tape, hook and loop fasteners (Velcro™ tape), or removable glue.

The religious mountable ornament 10, as shown in FIGS. 1 to 3, includes a dispenser container 20 for holding and dispensing holy water 12. The dispenser container 20 includes a dispensing member 22 having a cap cover 40, a neck section 24 and a container housing 26. The dispensing member 22 includes a spray nozzle 28 for spraying the holy water 12 on a user, a pump head cap member 30 for pumping the holy water 12 from the container housing 26 to the spray nozzle 28, and a plastic dispensing line (tube) 32 for transferring the holy water 12 to the spray nozzle 28. The dispensing member 22 also includes a cap member 34 having internally threaded walls 36 for attaching to the externally threaded walls 38 of the neck section 24 of the container housing 26, as shown in FIG. 1 of the drawings.

The container housing 26 includes a front wall 42, a rear wall 44, side walls 46 and 48 and a bottom wall 50 for forming an interior compartment 52 for holding and containing holy water 12 therein. Front wall 42 includes an integrally molded religious medal or symbol 56 thereon also having an indicia section 58 thereon. Rear wall 44 includes an integrally attached channel tab member or bar member 62 being vertically aligned and centrally located on the rear wall 44. Bar member 62 includes slanted walls 64*a* and 64*b* for being received within the U-shaped and tapered receiving channel 80 of the mounting plate member 70. Container housing 26 can be made from moldable plastic or formable light-weight metals such as aluminum, stainless steel, steel, zinc, copper or other metals.

Mounting plate member 70, as shown in FIGS. 3 and 4 of the drawings, includes a front wall 72, a rear wall 74, and a plurality of screw hole openings 76*a*, 76*b*, 76*c* and 76*d* being used for attaching to a door or a wall 14 via screws 78. Front wall 72 also includes a centrally located and vertically aligned U-shaped and tapered receiving channel 80 for receiving the bar member 62 located on rear wall 44 of container housing 26 in order to hold the religious ornament 10 on wall 14.

ALTERNATE EMBODIMENT 100

The religious mountable ornament 100 and its component parts of the alternate embodiment of the present invention are represented in detail by FIGS. 5 through 8. The religious ornament 100 includes a dispenser container 120 for holding and dispensing holy water 12, and a holding member 160 for retaining the dispenser container 120 therein. The holding member 160 is mountable on a door or a wall 14 of a home or a building. In addition, holding member 160 can also be temporarily attached to an interior wall or door of a vehicle, such as a car, a truck, a van, a bus, a train, an airplane or a recreational vehicle using double-sided tape, hook and loop fasteners (Velcro™ tape), or removable glue.

The dispenser container 120 includes a dispensing member 122 having a cap cover 152, a neck section 136 and a container housing 138. The dispensing member 122 includes a spray nozzle 124 for spraying the holy water 12 on a user, a pump head cap member 126 for pumping the holy water 12 from the container housing 138 to the spray nozzle 124, and a plastic dispensing tube 128 for transferring the holy water 12 to the spray nozzle 124. The dispensing member 122 also includes a cap member 130 having internally threaded walls 132 for attaching to the externally threaded walls 134 of the neck section 136 of container housing 138. The container housing 138 includes a front wall 140, a rear wall 142, side walls 144 and 146 and a bottom wall 148 for forming an interior compartment 150 for storing the holy water 12 therein. Container housing 138 can be made from moldable plastic or formable light-weight metals (i.e. aluminum, steel, stainless steel, zinc, copper or others).

Figure 5:
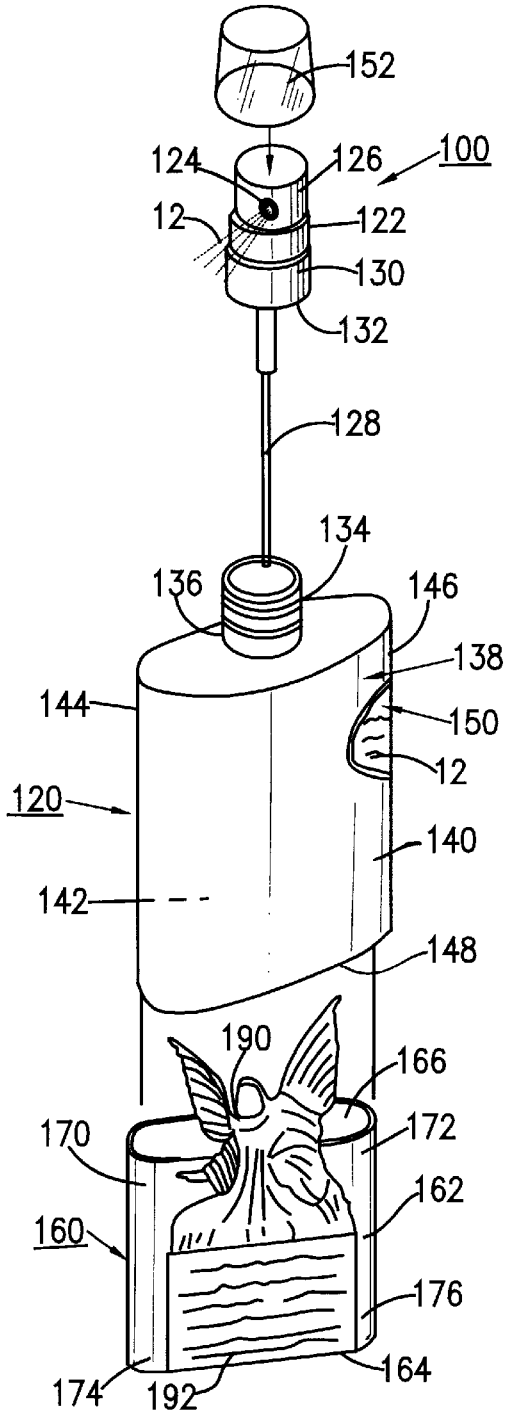
FIG. 5 is an exploded front perspective view of the religious mountable ornament of the alternate embodiment of the present invention showing the cover cap, the dispensing member, the dispenser container and the holding member.
Figure 6:
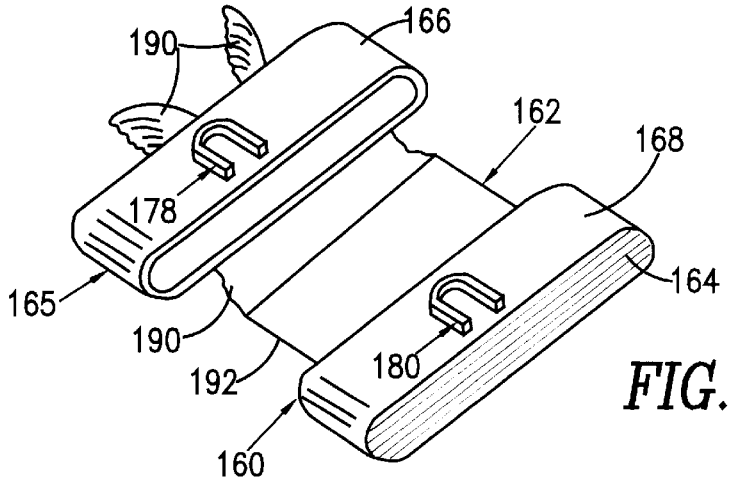
FIG. 6 is a rear perspective view of the religious mountable ornament of the alternate embodiment of the present invention showing the holding member having upper and lower curved band members with each having an inverted U-shaped channel member thereon.
Figure 8:
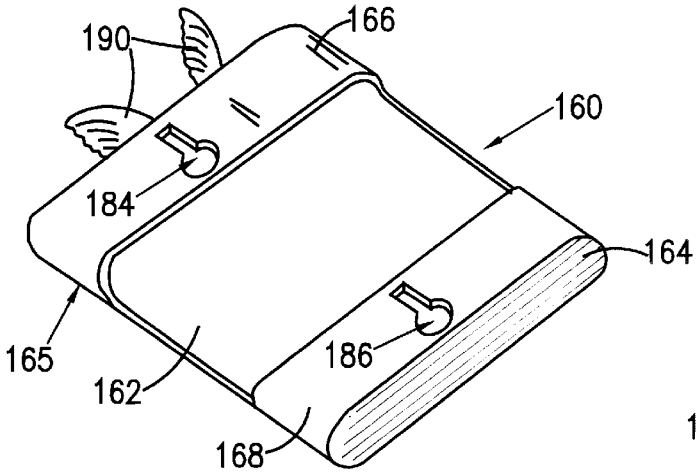
FIG. 8 is a rear perspective view of the religious mountable ornament of the alternate embodiment of the present invention showing the holding member having upper and lower band members with each having an inverted keyhole slot therein.
Figure 7:
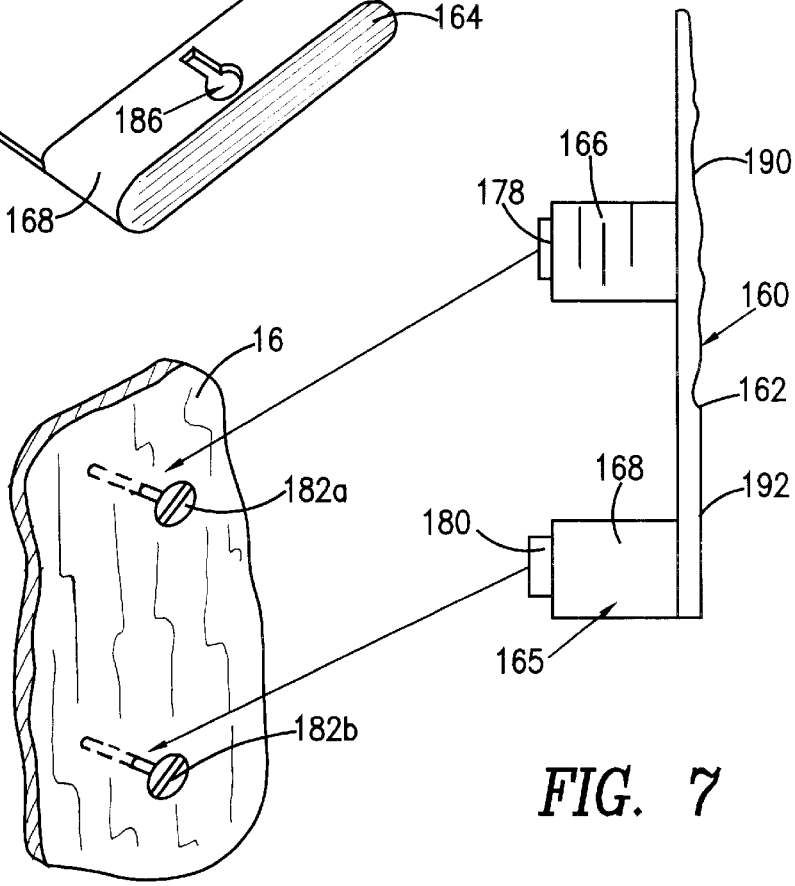
FIG. 7 is a side elevational view of the religious mountable ornament of the alternate embodiment of the present invention showing the inverted U-shaped channel members on each of the upper and lower band members of the holding member being attached and mounted on a pair of vertically aligned screws for mounting the holding member on the door of the user's home.

The holding member 160, as shown in FIGS. 5, 6 and 8 of the drawings, includes a front wall 162, a bottom wall 164, and a partial back wall 165 in the form of upper and lower curved bands 166 and 168. The upper curved band 166 is integrally attached to the upper corners 170 and 172 of front wall 162; and the lower curved band 168 is integrally attached to the lower corners 174 and 176 of front wall 162, respectively. Each of the upper and lower bands 166 and 168, as shown in FIGS. 6 and 8 of the drawings, include a centrally located inverted U-shaped channel member 178 and 180 for attaching and receiving screw heads or nail heads 182*a* and 182*b* for attaching and mounting the holding member 160 on the wall or the door 16 of the user's home (as shown in FIG. 7). Holding member 160 can be made from moldable and durable plastic or from formable light-weight metals such as aluminum, stainless steel, steel, zinc, copper or other metals. In addition, front wall 162 includes an attached religious medal or symbol 190 having an indicia section 192 thereon. Religious medal 190 can be formed from moldable plastic or formable light-weight metals, such as aluminum, stainless steel, steel, zinc, copper or other metals. Religious medal 190 can be attached and connected to front wall 162 using epoxy cement, spot welds, double-sided tape and the like.

As shown in FIG. 8, upper and lower curved bands 166 and 168 demonstrate a different type of holding means, each holding means being an inverted keyhole slot member 184 and 186 for attaching and receiving screw heads or nail heads 182*a* and 182*b* for attaching and mounting the holding member 160 on the wall or door 16 of the user's home.

OPERATION OF THE PRESENT INVENTION

In operation, the religious mountable ornaments 10 and 100 of the preferred and alternate embodiments of the present invention operate in the same manner. In each embodiment, the user brings the dispenser 20 or 120 to their Catholic Church in order to fill their dispensers 20 or 120 with holy water 12 from their priest or church representative. The user is then able to mount and attach each of the embodiments to an appropriate wall or door of the user's home or work place.

In attaching the religious ornament 10 of the preferred embodiment to a wall 14 or a door 16, the user's first step is to attach the mounting plate 70 to a properly located location on the user's wall 14 or door 16 via screws 78 through screw hole openings 76*a* to 76*d*, as shown in FIG. 3 of the drawings.

Next, the user then inserts the bar member 62 of container housing 26 within the U-shaped and tapered receiving channel 80, as shown in FIG. 4 of the drawings, for holding the religious ornament 10 on wall 14.

The user then removes cap cover 40 from the dispensing member 22, and the user then depresses the pump cap member 30 and sprays their hand (or other body area) with holy water 12 via spray nozzle 28 for blessing oneself with the sign of the cross.

In attaching the religious ornament 100 of the alternate embodiment to a door 16 or a wall 14, the user's first step is to attach and mount the holding member 160 to a properly located position on the user's wall 14 or door 16 via screw heads or nail heads 182*a* and 182*b*. In this manner, the inverted U-shaped channel members 178 and 180 or the inverted keyhole slot members 184 and 186 are received and attached on the screw heads or nail heads 182*a* and 182*b*, as depicted by FIG. 7 of the patent drawings, for mounting the holding member 160 to the wall 14 or the door 16 of the user's home or place of work. The next step is simply inserting the dispenser 120 within the confines of holding member 160, where then the user is ready to operate the religious ornament 100 of the alternate embodiment.

The user now removes cap cover 152 from the dispensing member 122, and then the user depresses the pump cap member 126 and sprays their hand with holy water 12 via spray nozzle 124 for blessing oneself with the sign of the cross.

When the user has emptied the dispenser 20 or 120 of holy water 12, the user simply unscrews the dispensing cap member 34 and 130 from the neck section 24 and 136 of container housings 26 and 138. The user then simply refills the dispenser 20 or 120 with holy water 12 and screws back the dispensing cap member 34 and 130 on neck section 24 and 136 of container housings 26 and 138. The user is again ready to spray holy water 12 via spray nozzle 28 or 124 in order to have a holy water 12 blessing.

ADVANTAGES OF THE PRESENT INVENTION

Accordingly, it an advantage of the present invention it that it provides for a mountable religious ornament having a holy water dispenser therewith for holding and dispensing holy water on the user.

Another advantage of the present invention is that it provides for a mountable religious ornament that is made from a moldable and durable plastic is made from a formable metal such as aluminum, steel, stainless steel, zinc, copper or other metals.

Another advantage of the present invention is that it provides for a mountable religious ornament that can be mounted on a door or wall of a home or building, as well as temporarily attached to an interior wall or door of a vehicle.

Another advantage of the present invention is that it provides for an alternate mountable religious ornament that includes a dispenser for holding and dispensing holy water, and a holding member having a religious symbol thereon such that the dispenser is retained within the holding member.

Another advantage of the present invention is that it provides for a mountable religious ornament having a holding member made from a moldable and durable plastic or is made from formable metal such as aluminum, stainless steel, steel, zinc, copper or other metals.

A further advantage of the present invention is that it provides for a mountable religious ornament that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A holy water dispenser including a religious ornament thereon mountable on a wall or door, comprising:

a) a dispensing container for holding and dispensing holy water on the user;

b) a spray nozzle and pump removably mounted on said dispensing container for spraying holy water on the user; said spray nozzle and pump being removable to refill said dispensing container;

c) a religious ornament mounted on the front of said dispensing container for displaying a religious entity; and d) means for mounting said dispensing container on a wall or a door of a home or a building.

2. A holy water dispenser in accordance with claim 1, wherein said means for mounting includes a mounting plate member for attaching to a wall.

3. A holy water dispenser in accordance with claim 2, wherein said mounting plate member includes a U-shaped receiving channel.

4. A holy water dispenser in accordance with claim 3, wherein said dispensing container includes a rear wall having an integrally attached and vertically arranged bar for inserting into said U-shaped receiving channel.

5. A holy water dispenser in accordance with claim 1, wherein said dispensing container is made from a moldable and durable plastic.

6. A holy water dispenser in accordance with claim 1, wherein said dispensing container is made from a formable, light-weight metal selected from the group consisting of aluminum, stainless steel, steel, zinc and copper.

7. A holy water dispenser in accordance with claim 1, wherein said means for mounting said dispensing container includes double-sided tape for attaching to an interior wall or door of a vehicle.

8. A holy water dispenser in accordance with claim 1, wherein said religious ornament is in the form of a religious symbol having an indicia section thereon.

9. A holy water dispenser in accordance with claim 1, wherein said dispensing container includes a spray dispenser for spraying the holy water.

10. A holy water dispenser in accordance with claim 1, wherein said dispensing container is a refillable container or a bottle for holding the holy water.

11. A holy water dispenser in accordance with claim 1, wherein said means for mounting said dispensing container includes hook and loop fasteners for attaching to an interior wall or door of a vehicle.

12. A holy water dispenser including a religious ornament thereon mountable on a wall or door, comprising:

a) a dispensing container for holding and dispensing holy water on the user;

b) a spray nozzle and pump removably mounted on said dispensing container for spraying holy water on the user; said spray nozzle and pump being removable to refill said dispensing container;

c) a holding member having a front wall and an interior compartment for receiving and holding said dispensing container in place;

d) a religious ornament mounted on said front wall of said holding member for displaying a religious entity; and e) mounting means for mounting said holding member on a wall or a door of a home or a building.

13. A holy water dispenser in accordance with claim 12, wherein said holding member is a holding container for receiving said dispensing container therein.

14. A holy water dispenser in accordance with claim 12, wherein said holding member includes said front wall, a bottom wall, and a partial back wall for holding in place said dispensing container.

15. A holy water dispenser in accordance with claim 14, wherein said partial back wall includes said mounting means being centrally located thereon for mounting said holding member on a wall or a door of a home or a building.

16. A holy water dispenser in accordance with claim 15, wherein said mounting means includes a pair of inverted U-shaped channel members for receiving screws or nails for mounting said holding member on a wall or a door of a home or a building.

17. A holy water dispenser in accordance with claim 15, wherein said mounting means includes a pair of inverted keyhole slot members for receiving screws or nails therein for mounting said holding member on a wall or a door of a home or a building.

18. A holy water dispenser in accordance with claim 12, wherein said religious ornament is mounted on said front wall of said holding member using epoxy cement.

19. A holy water dispenser in accordance with claim 12, wherein said religious ornament is in the form of a religious symbol having an indicia section thereon.

20. A holy water dispenser in accordance with claim 12, wherein said religious ornament is made from a moldable and durable plastic.

21. A holy water dispenser in accordance with claim 12, wherein said religious ornament is made from a formable, light-weight metal selected from the group consisting of aluminum, stainless steel, steel, zinc and copper.

22. A holy water dispenser in accordance with claim 12, wherein said dispenser is made from a moldable and durable plastic.

23. A holy water dispenser in accordance with claim 12, wherein said dispensing container is made from a formable, light-weight metal selected from the group consisting of aluminum, stainless steel, steel, zinc and copper.

24. A holy water dispenser in accordance with claim 12, wherein said means for mounting said holding member includes double-sided tape for attaching to an interior wall or door of a vehicle.

25. A holy water dispenser in accordance with claim 12, wherein said holding member is made from a moldable and durable plastic.

26. A holy water dispenser in accordance with claim 12, wherein said holding member is made from a formable, light-weight metal selected from the group consisting of aluminum, stainless steel, steel, zinc and copper.

27. A holy water dispenser in accordance with claim 12, wherein said dispensing container includes a spray dispenser for spraying the holy water.

28. A holy water dispenser in accordance with claim 12, wherein said dispensing container is a refillable container or a bottle for holding the holy water.

29. A holy water dispenser in accordance with claim 12, wherein said religious ornament is mounted on said front wall of said holding member using spot welds.

30. A holy water dispenser in accordance with claim 12, wherein said religious ornament is mounted on said front wall of said holding member using double-sided tape.

31. A holy water dispenser in accordance with claim 12, wherein said means for mounting said holding member includes hook and loop fasteners for attaching to an interior wall or door of a vehicle.

* * * * *